US009549618B1

(12) United States Patent
Honarvar

(10) Patent No.: US 9,549,618 B1
(45) Date of Patent: Jan. 24, 2017

(54) FOLDING BED AND FILING CABINET

(71) Applicant: Farhang Honarvar, North York (CA)

(72) Inventor: Farhang Honarvar, North York (CA)

( * ) Notice: Subject to any disclaimer, the term of this patent is extended or adjusted under 35 U.S.C. 154(b) by 0 days.

(21) Appl. No.: 15/265,927

(22) Filed: Sep. 15, 2016

(51) Int. Cl.

| | |
|---|---|
| ***A47C 17/58*** | (2006.01) |
| ***A47C 19/12*** | (2006.01) |
| ***A47B 46/00*** | (2006.01) |
| ***A47B 63/00*** | (2006.01) |
| ***A47B 88/12*** | (2006.01) |
| ***A47C 27/14*** | (2006.01) |

(52) U.S. Cl.
CPC ..... *A47C 17/58* (2013.01); *A47B 46/00* (2013.01); *A47B 63/00* (2013.01); *A47B 88/12* (2013.01); *A47C 19/12* (2013.01); *A47C 27/14* (2013.01)

(58) Field of Classification Search
CPC ..... A47B 83/00; A47B 85/00; A47D 7/007; A47C 17/52; A47C 17/54; A47C 17/56; A47C 17/58
See application file for complete search history.

(56) References Cited

U.S. PATENT DOCUMENTS

| | | | | | |
|---|---|---|---|---|---|
| 609,380 | A * | 8/1898 | Yeager | A47C 17/58 | 5/147 |
| 1,099,962 | A * | 6/1914 | Blake | A47C 17/56 | 5/135 |
| 2,127,025 | A * | 8/1938 | McKeithan | A47C 17/58 | 5/182 |
| 3,686,697 | A * | 8/1972 | Kakalios | A47C 17/52 | 5/152 |
| 3,752,550 | A * | 8/1973 | Niemeyer | A47B 79/00 | 312/237 |
| 4,288,130 | A * | 9/1981 | Baldwin | A47B 31/00 | 211/182 |
| 5,978,988 | A * | 11/1999 | Burchett | A47C 17/40 | 5/133 |
| 9,468,305 | B2 * | 10/2016 | Flora | A47C 17/58 | |
| 2001/0049843 | A1 * | 12/2001 | Barnett | A47C 19/122 | 5/159.1 |
| 2006/0238085 | A1 * | 10/2006 | Greenberg | A47B 51/00 | 312/306 |

* cited by examiner

*Primary Examiner* — David E Sosnowski
*Assistant Examiner* — Eric Kurilla
(74) *Attorney, Agent, or Firm* — Nasser Ashgriz UIPatent Inc.

(57) ABSTRACT

The present invention is a folding bed that is embedded into a filing cabinet. The folding bed comprises of three folding sections pivotably connected to each other to be sized to fit vertically into the compartment of the filing cabinet. The folding bed including a pull-push assembly to pull the folding bed out of the cabinet and a rotation system to rotate the folding bed from a vertical position into a horizontal position and reverse. When the door, which looks like a combination of two drawer doors, is opened, the folded bed is easily slid out of the cabinet and rotated to the right or left direction depending on the position of the cabinet proportional to a wall or other obstruction and opens the foldable bed in a horizontal position and retracts the foldable legs to support the bed on the floor.

17 Claims, 15 Drawing Sheets

FOLDING BED AND FILING CABINET

FIELD OF THE INVENTION

The present invention relates in general to folding beds and in specific to folding beds which are stored in a cabinet.

BACKGROUND OF THE INVENTION

People who work in an office all day long, usually need to take a short rest (nap) during the daytime. Studies have shown that a short nap of 20-30 minutes can help to improve mood, alertness and performance. Shift work may cause fatigue and performance impairments, especially for night shift workers.

Nowadays more and more companies are encouraging employees to take an on-site nap. Data shows that 29% of workers report falling asleep or becoming very sleepy at work, and a lack of sleep costs the United States $63 billion each year in lost productivity. However a short nap can boost alertness and improve performance.

Many companies have set up a quiet room for their employees, where they can nap or even meditate during the day. Some other companies have introduced "nap pods," which are futuristic-looking lounge chairs that play soothing sounds so workers can catch a quick snooze when they need one. One of the main issues with such nap spaces is that they are usually full and booked and may not be available at all times.

To benefit from a short nap in a work place, and considering the limited space, a foldable and convertible bed that can fit in a filing cabinet would be very desirable. Filing cabinets exist in most work spaces, and a filing cabinet with a bed inside it would not change the look of the office space. The current cabinet-type folding beds are not suitable for an office and they are usually made for use in a house. There are also folding beds that can be stored under a desk, but they are generally too large and bulky to be used in an office space.

There is also other convertible furniture disclosed in the prior art that provides a way to conserve living space while providing temporary sleeping accommodations. Most of them have complicated mechanism for unfolding, which adds unnecessary weight to the cabinet.

In summary, the currently available folding beds are not suitable for use in an office and they need extra space for storage. Also, the current cabinet beds are not suitable for use in an office environment.

SUMMARY OF THE INVENTION

The present invention provides a solution to the above problems by enabling a simply designed folding cabinet bed with a folding bed frame assembly that opens into a full-length bed. The folding bed is embedded into the lower part of a four-drawer filing cabinet. The filing cabinet looks like a regular filing cabinet except that the lower two drawers are combined into one single compartment in which a folding bed is embedded. When the door, which looks like a combination of two drawer doors, opens, the folded bed easily slides out of the cabinet and unfolds into a single bed. This design keeps two drawers of the filing cabinet available for office usage while having a folding bed in the lower part of the cabinet.

The cabinet compartment may have any size. The bed frame is folded longitudinally and is sized to have a length equal to the length and width of the lower part of the cabinet compartment. By folding the bed longitudinally in three sections, the package can be fitted in the lower part of the cabinet compartment.

A drawer assembly comprising of a scissor shaped pull-push system is provided to slide the folded bed into and out of the cabinet compartment. The drawer assembly comprises of a rotatable attachment that have a socket embedded in a vertical railing. The vertical railing can slide in a horizontal railing attached to the rear wall of the cabinet to allow for both rotational, vertical and horizontal movements. The rotatable assembly is rotatable and slidable in two directions and is attached to the railing of the rear wall of the cabinet, so the bed can rotate by 360 degrees and slide both upward and downward and also both to the right and left sides.

The folding bed sections have a pivoting structure to fold different sections of the bed frame and the mattress. Two pivoted legs are configured on the rear side of each bed frame section to support the bed assembly on the floor on both sides and the middle of the bed. The support legs pivot inwardly to conceal under the bed frames.

It is therefore, an object of the present invention to enable a folding bed with a folding frame and mattress that closes into a compact configuration within the filing cabinet and extends to the desired length.

It is another object of the present invention to provide a folding bed comprising of a drawer and rotation system to embed the folded bed in the filing cabinet.

It is another object of the present invention to enable a folding cabinet bed having a simple design for an easy operation.

It is another object of the present invention to provide an office bed that can be stored in a filing cabinet and be a part of the office furniture and be invisible when stored in the filing cabinet.

It is another object of the present invention that the bed could be used when the cabinet is away or next to a wall on its right or left side.

It is another object of the present invention to provide an integrated bed and filing cabinet.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modifications and alterations, and that the disclosed invention be limited only by the claims and equivalents thereof.

DETAILED DESCRIPTION OF PREFERRED EMBODIMENTS

The invention disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
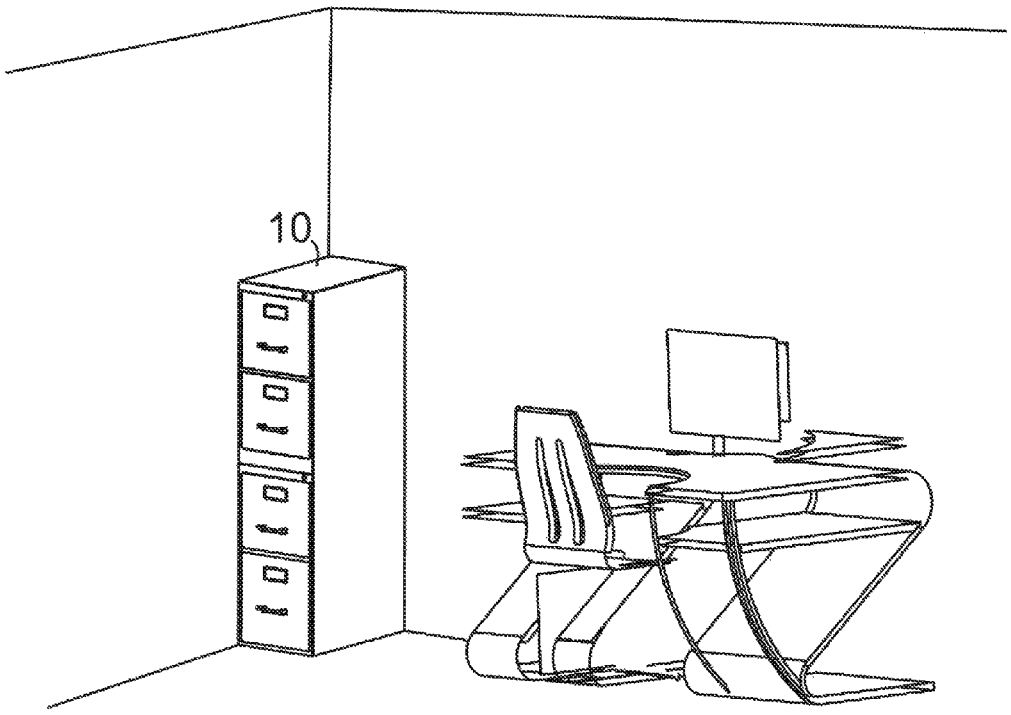
FIG. 1 shows a perspective view of an office space with the present invention.

FIG. 1 shows a perspective view of an office space with a filing cabinet with a foldable bed 10. The filing cabinet with a foldable bed 10 can be placed near a wall. The extension of the foldable bed outside of the filing cabinet which is located near the wall is practical, because of the rotatable attachment means and a slidable attachment means of the present invention.

Figure 2:
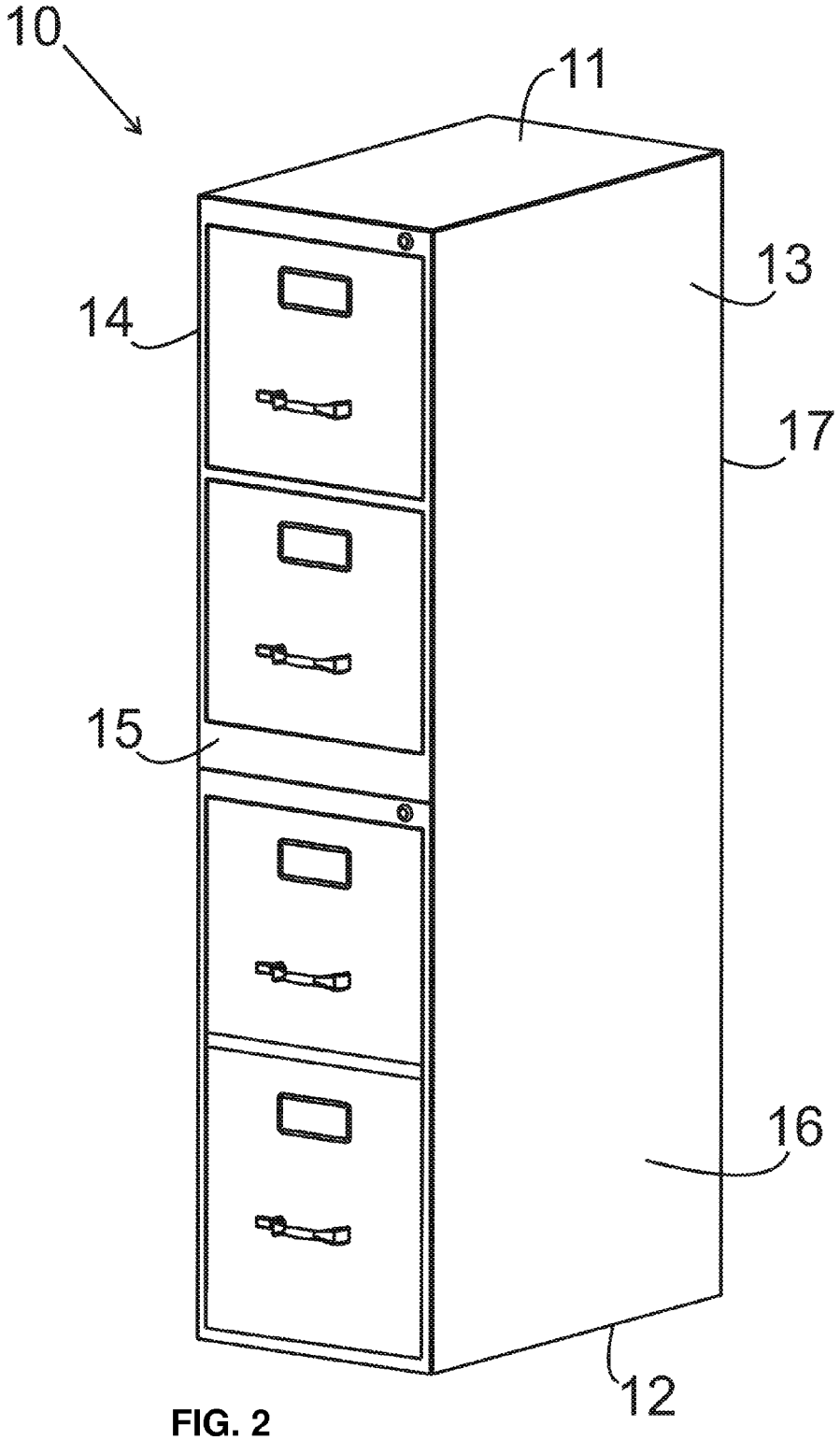
FIG. 2 shows a perspective view of the folding cabinet bed of the present invention.
Figure 3:
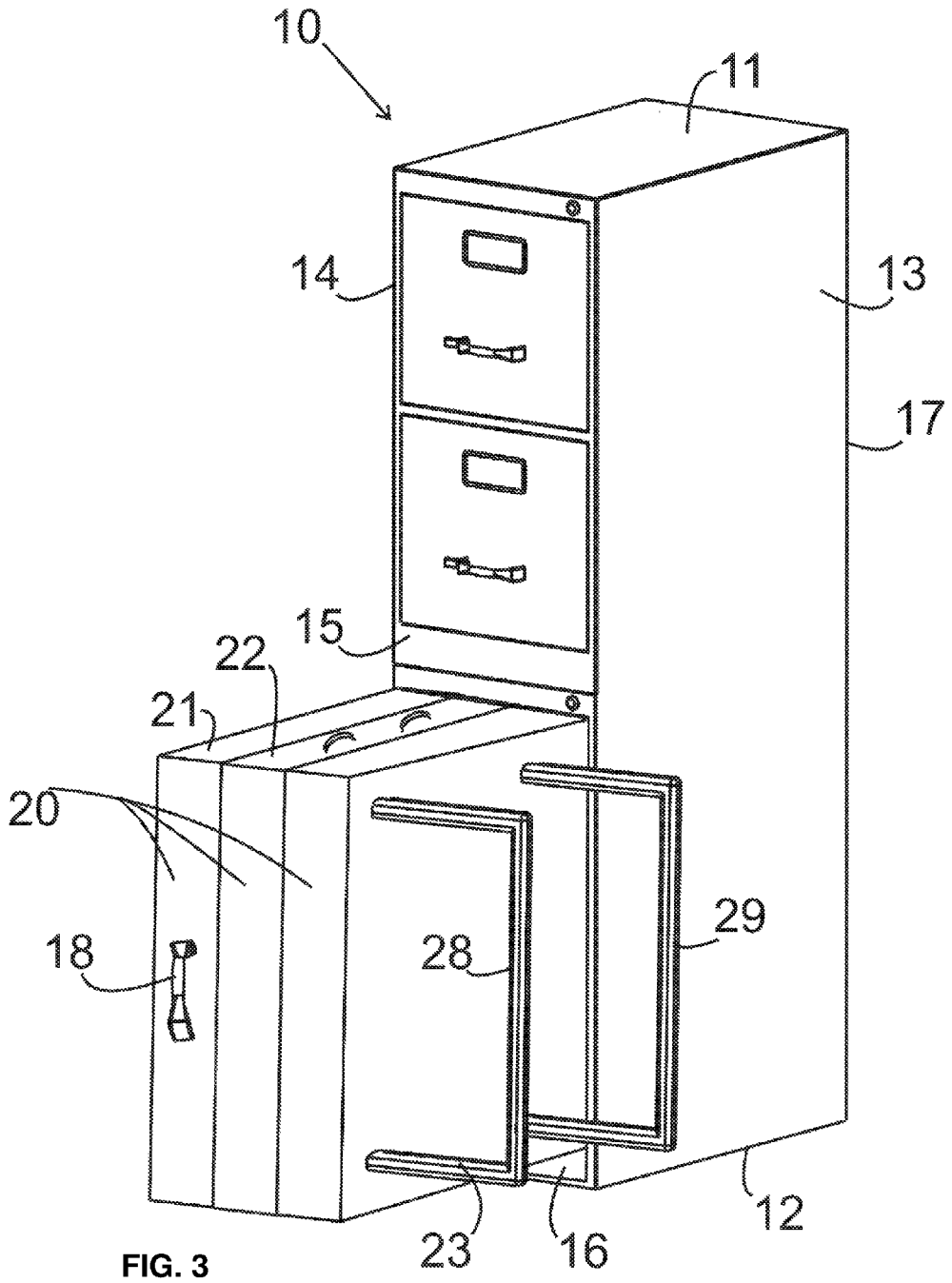
FIG. 3 shows a perspective view of the folding cabinet bed with the folded bed slid out of the cabinet.

According to FIGS. 2 and 3 the present invention is a combination cabinet and folding bed wherein the bed is stored in the cabinet. The system comprises of a filing cabinet 10 having a top wall 11, a bottom wall 12, a rear wall 17 and side walls 13 and 14. These walls form a chamber or opening which is separated to two sections 15 and 16. The upper section utilizes as filing drawers 15 and the lower section of the opening 16 is to accommodate a folding bed 20. The front face of the filing cabinet 10 looks as a usual office filing cabinet when the bed 20 is in retracted position.

The direction of the legs 28-29 should be in a way that when a user pulls the bed out of cabinet, the legs automatically open and when the user pushes the bed into the cabinet, the legs automatically close.

By folding the bed 20 longitudinally in three sections 21, 22 and 23, the bed transforms into a package with a depth of 25-35 inches, and height of 28-38 inches and width of 15-24 inches. A rotation system to slid and fit the folded bed in the cabinet compartment 16 is provided for a transversal rotation and slid the folded bed into the cabinet compartment 16.

Figures 4A, 4B, 4C:
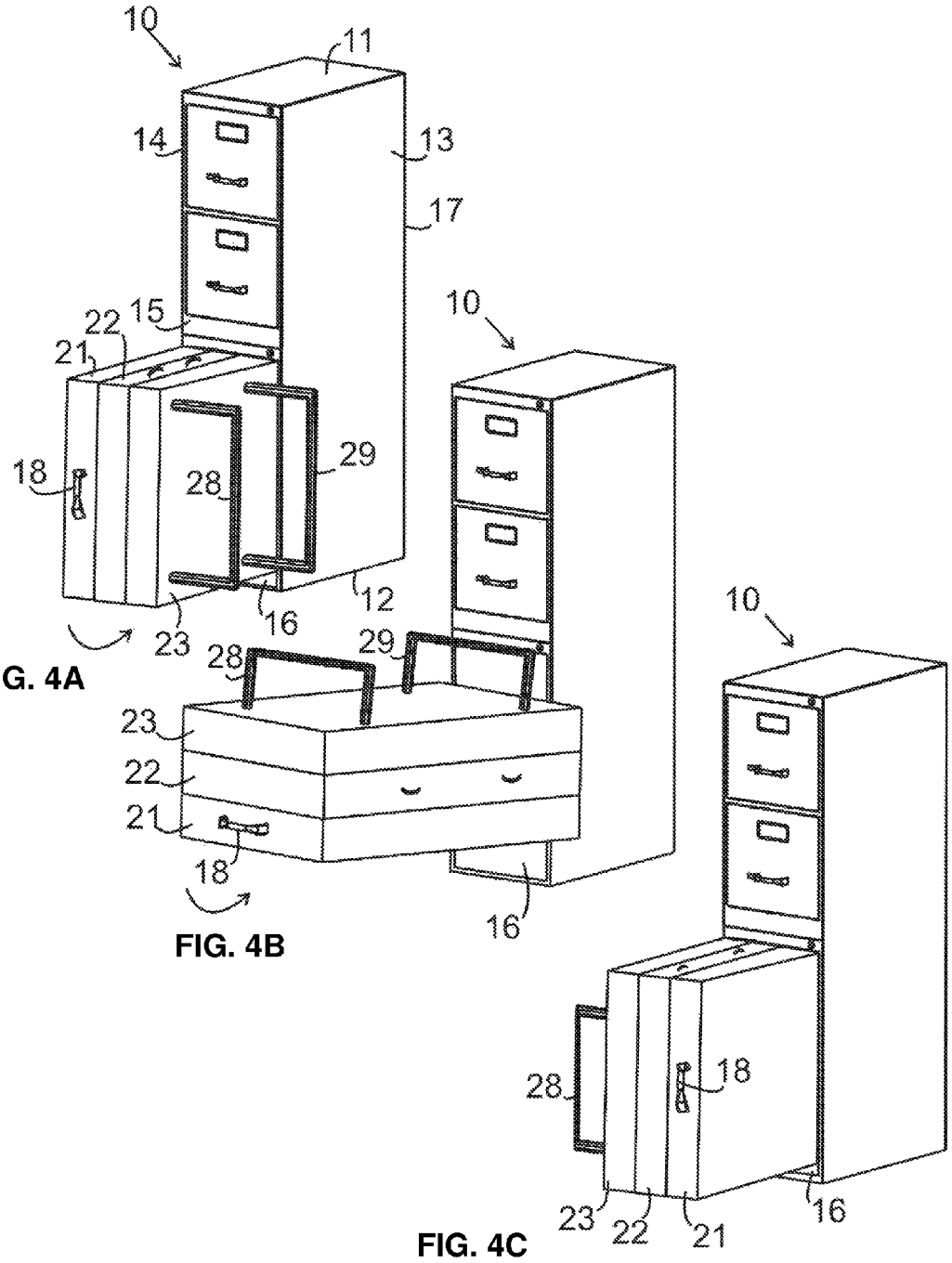
FIG. 4A shows a perspective view of the folding cabinet bed with the folded bed slid out of the cabinet.
FIG. 4B shows a perspective view of the folding cabinet bed with the folded bed slid out of the cabinet and rotated 90 degrees counter-clockwise.
FIG. 4C shows a perspective view of the folding cabinet bed with the folded bed slid out of the cabinet and rotated 180 degrees counter-clockwise.
Figure 5:
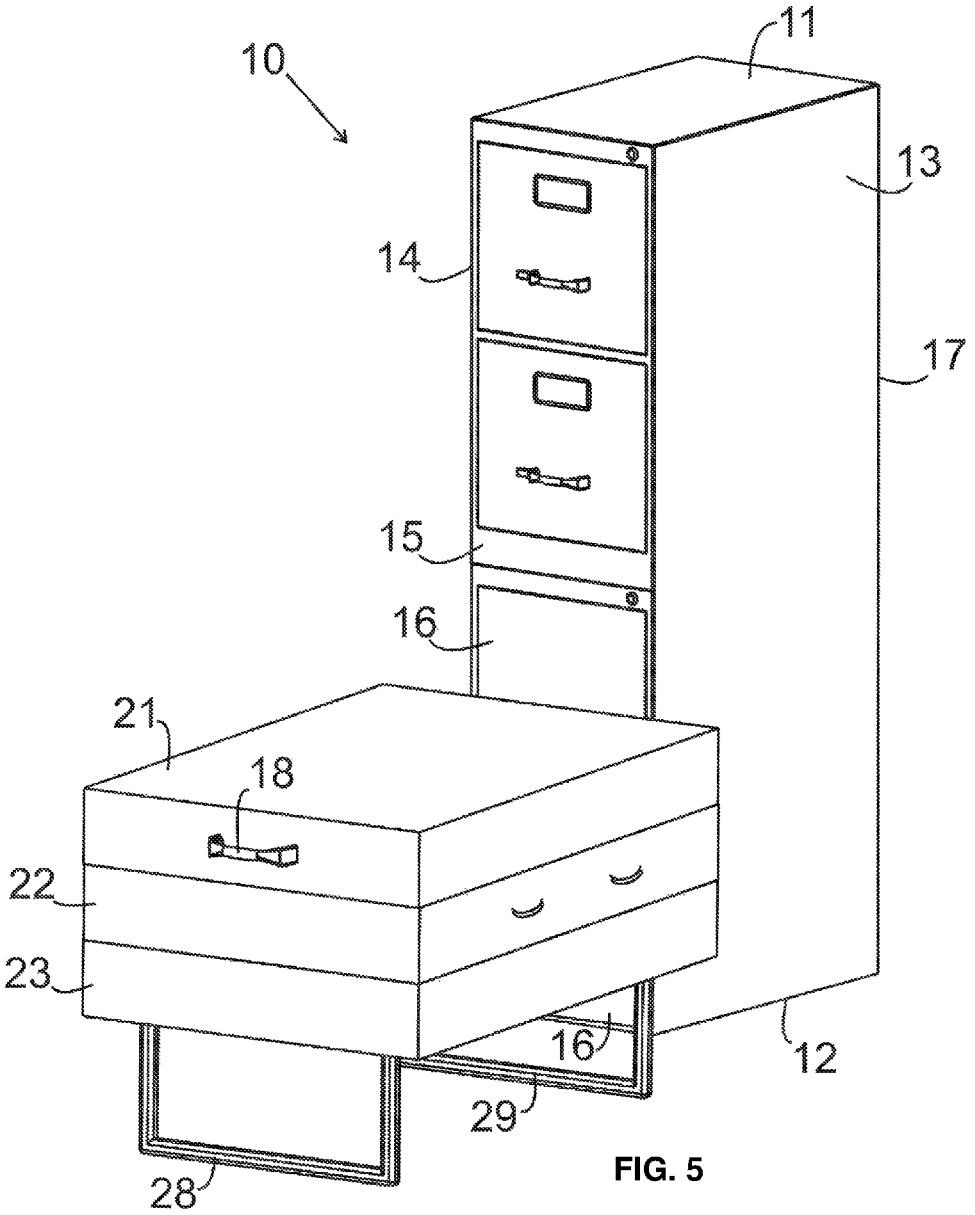
FIG. 5 shows a perspective view of the folding cabinet bed with the folded bed slid out of the cabinet and rotated 90 degrees clockwise.

Before placing the cabinet in a room, depending on the position of the cabinet and whether its right or left side is next to a wall, as shown in FIGS. 4A, 4B and 4C, the user can pull the bed out of the cabinet compartment 16 by pulling the handle 18 and rotate the foldable bed 21-23 in either a clockwise or a counter-clockwise direction depending on the position of the cabinet proportional to a wall or other obstruction. The foldable bed 21-23 can rotate clockwise or contraclockwise.

As shown in FIGS. 5, 6, 7 and 8, the foldable bed comprising of a first section 21, a second section 22, and a third section 23, each section having a first end and a second end, and wherein the second end 51 of the first section 21 is foldable attached to the first end 53 of the second section 22 and the second end 54 of the second section 22 is foldable attached to the first end 56 of the third section 23. By pulling out the foldable bed 21-23 from the cabinet compartment 16 and rotating the foldable bed 21-23 to the horizontal position, two foldable legs 28-29 of the third section 23 support the foldable bed 21-23.

Figure 6:
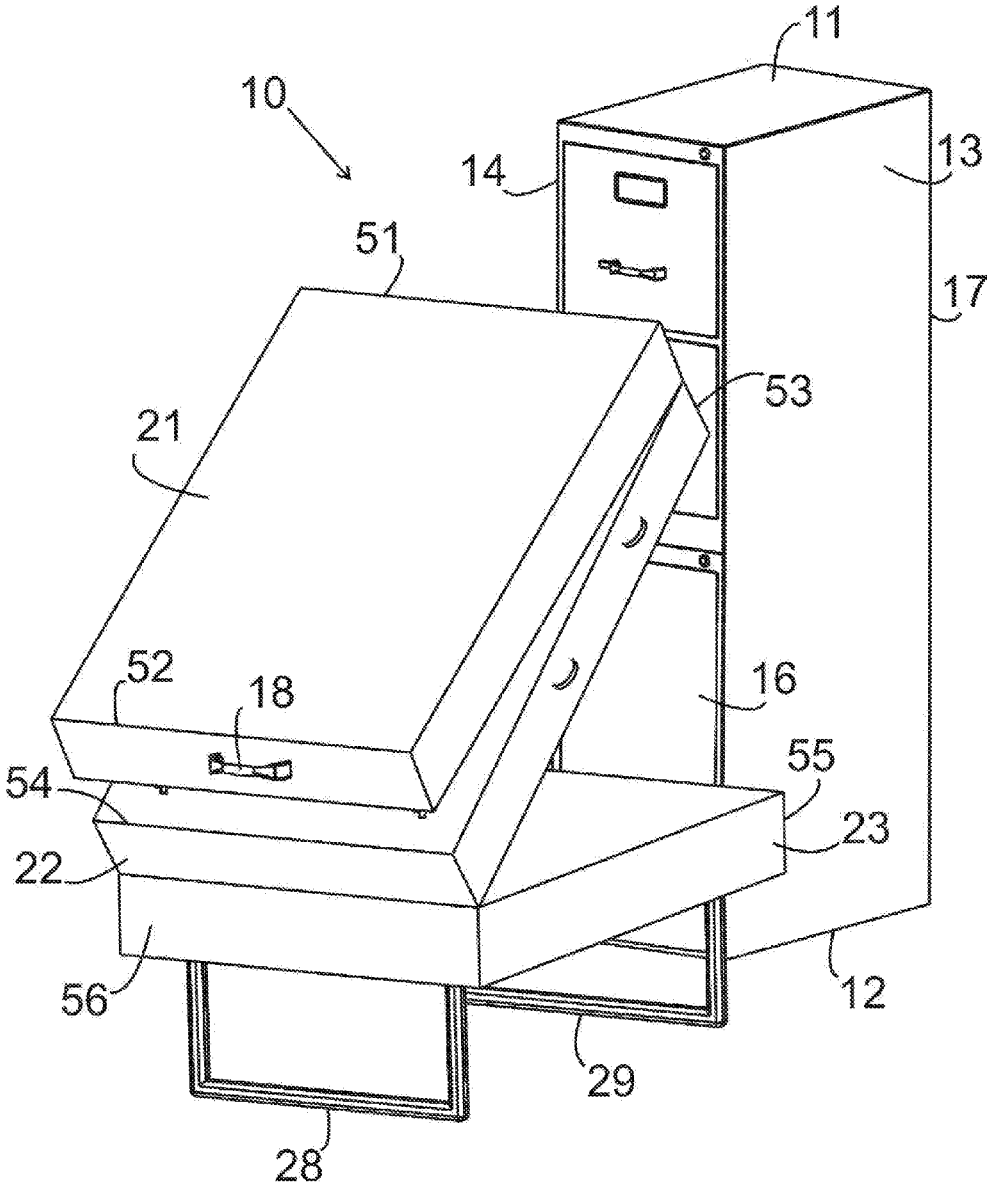
FIG. 6 shows a perspective view of the folding cabinet bed with the folded bed partially extended.
Figure 7:
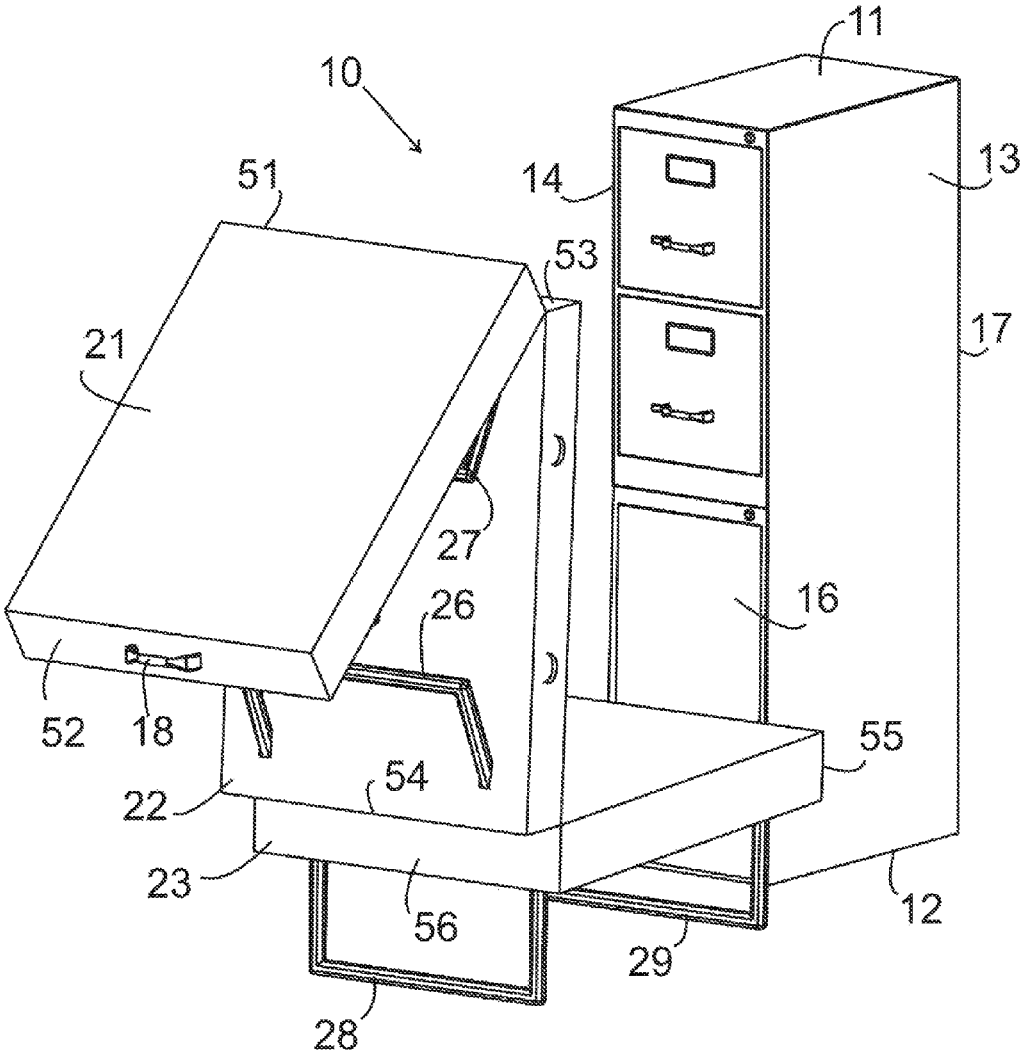
FIG. 7 shows a perspective view of the folding cabinet bed with the folded bed partially extended.

FIGS. 6, 7 illustrate the present invention in which the bed assembly 20 is in a partial extended position and shows bed frame sections 21, 22 and 23 supported by support legs 28-29, respectively. The bed frame 20 comprises of three foldable sections 21-23, an upper section 21, a middle section 22 and a lower section 23 with a pivoting structure for pivoting the three bed sections 21, 22 and 23 to retract or extend the bed frame 20.

Figure 8:
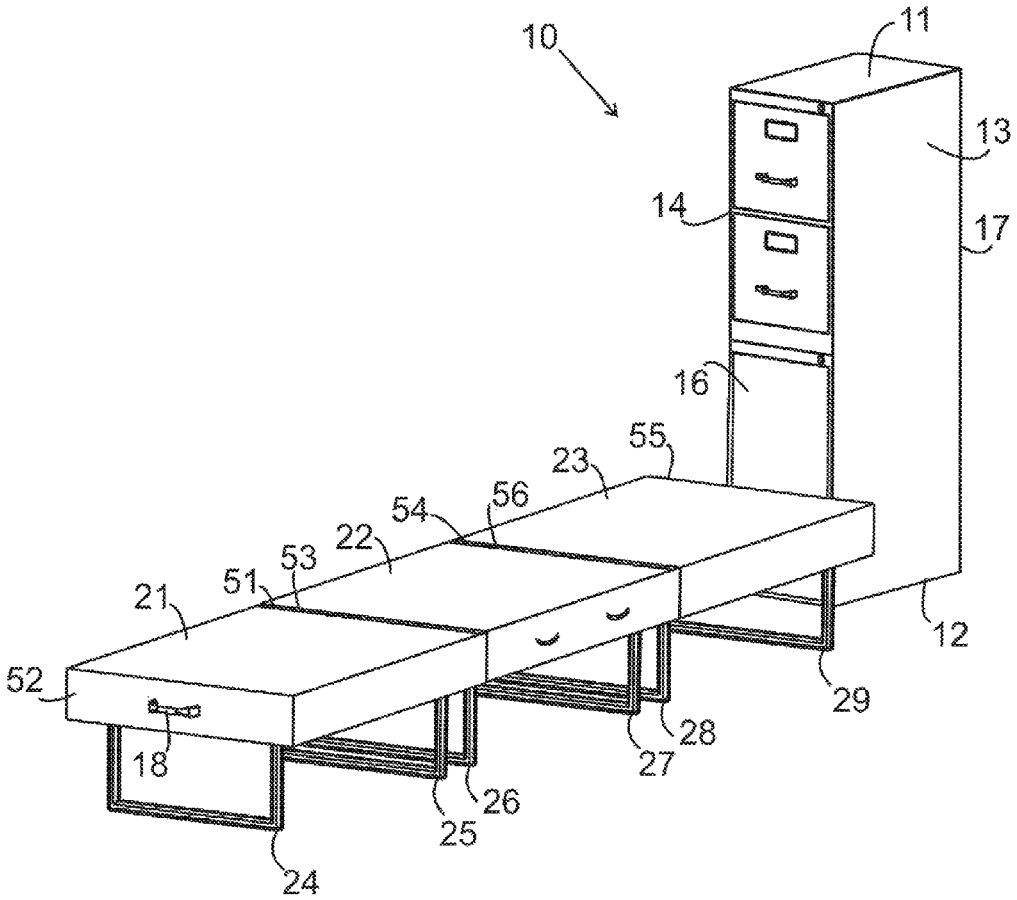
FIG. 8 shows a perspective view of the present invention in the extended position.

FIG. 8 shows a perspective view of the present invention in the extended position. The bed assembly is in an extended position and shows bed frame sections 21, 22 and 23 supported by support legs 24-29, respectively.

Figure 9A:
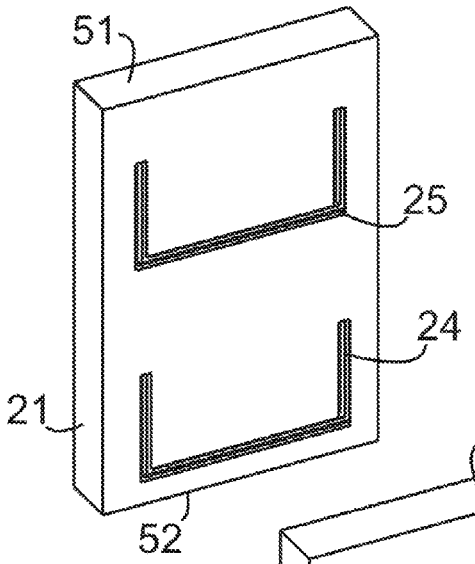
FIG. 9A shows a perspective view of a foldable bed frame of the present invention.
Figure 9B:
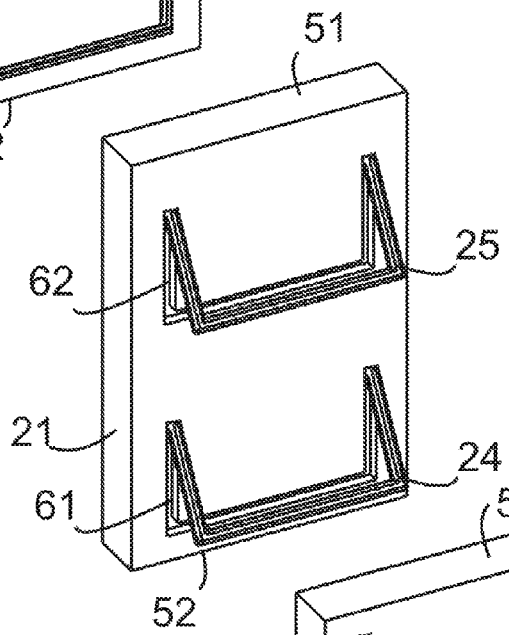
FIG. 9B shows a perspective view of a foldable bed frame of the present invention.
Figure 9C:
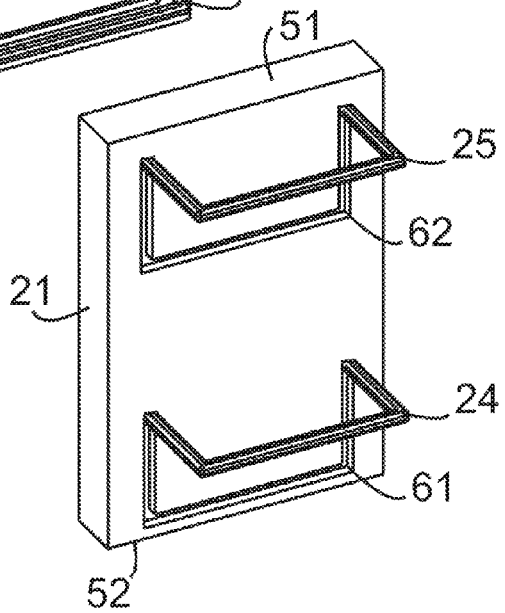
FIG. 9C shows a perspective view of a foldable bed frame of the present invention.
Figure 10A:
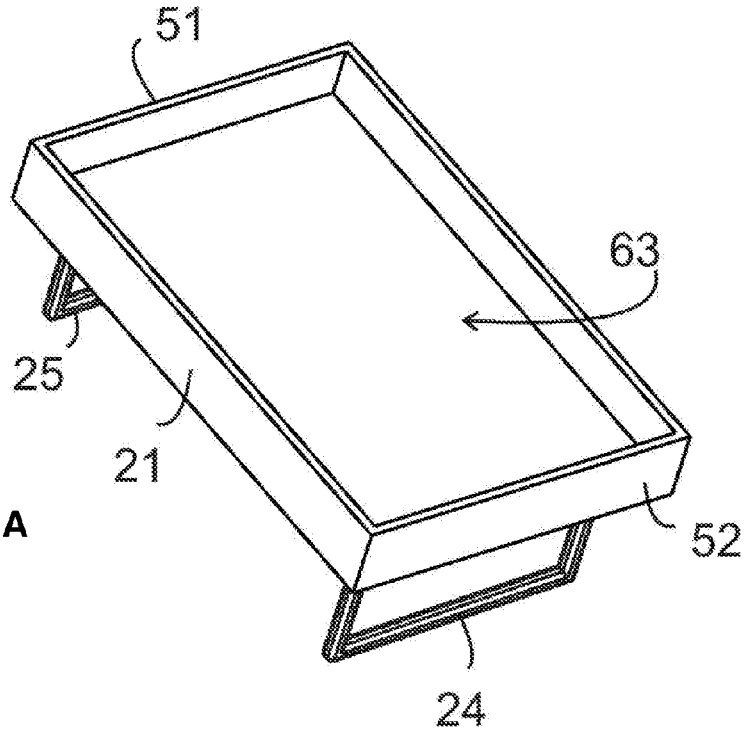
FIG. 10A shows a perspective view of a foldable bed frame of the present invention.
Figure 10B:
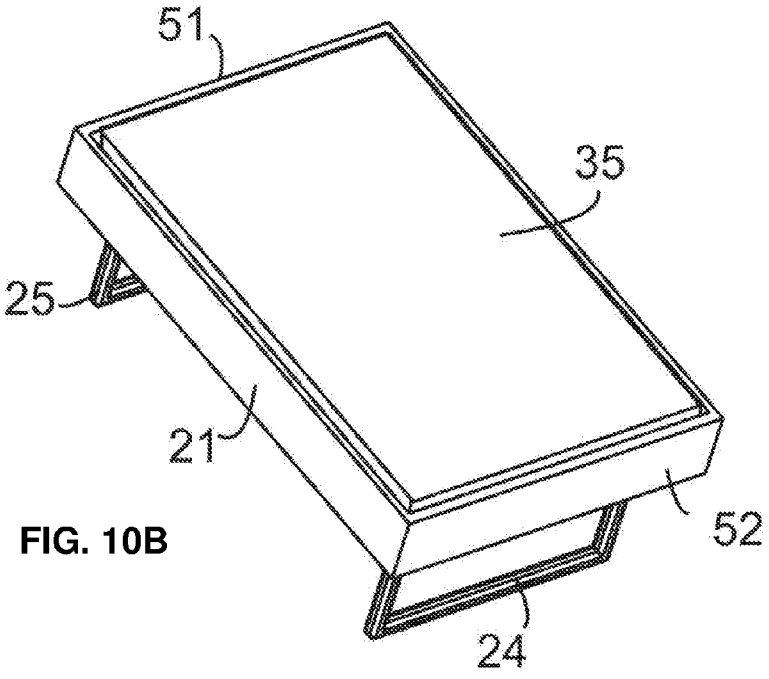
FIG. 10B shows a perspective view of a foldable bed frame of the present invention.
Figure 11A:
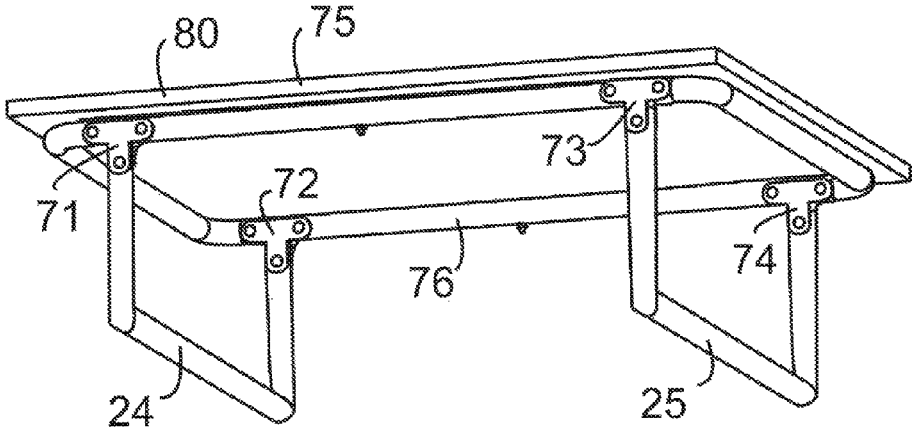
FIG. 11A shows a perspective view of a foldable bed frame of the present invention.
Figure 11B:
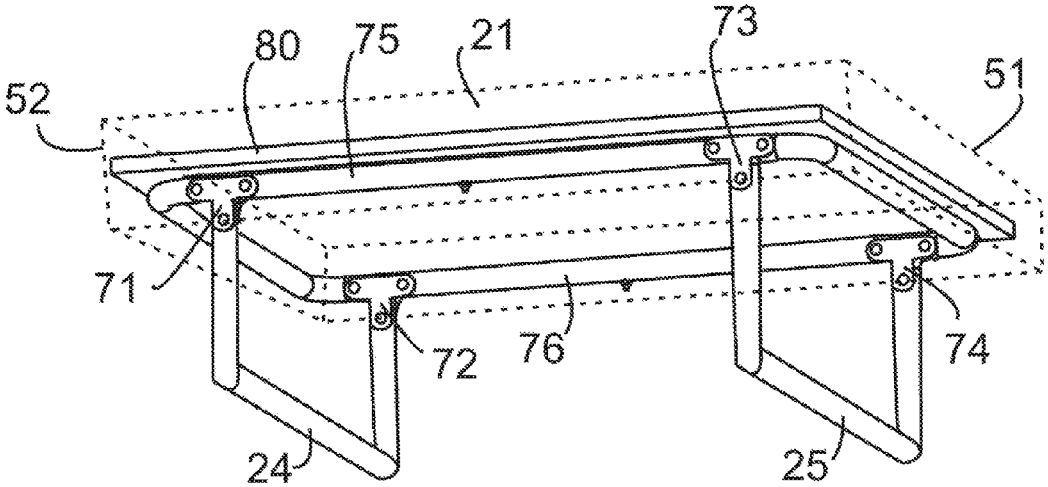
FIG. 11B shows a perspective view of a foldable bed frame of the present invention.

As shown in FIGS. 9A, 9B, and 9C, a pair of foldable legs 24, 25 attached to said foldable bed frame 21 to support the bed 21 on a floor. The pair of foldable legs 24, 25 are pivotally attached to the bed frame 21. In one embodiment of the present invention, a pair of gaps 61-62 are sized and designed under the bed frame 21 to receive the pair of foldable legs 24, 25. The pair of foldable legs 24, 25 can conceal under the bed frame 21.

As shown in FIGS. 10A, 10B, 11A and 11B, the bed frame 21 comprises of two pivoting legs 24 and 25 on each bed section to support the bed assembly on the floor. Legs 24 and 25 are coupled pivotally by 71-74 on the rear side of the upper section of the bed frame 21. Legs 24, 25 are pivotally connected to the bed frame 21, and pivotally collapse and rest on the bottom part of the bed frame 21.

Again as shown in FIGS. 10A, 10B, 11A, and 11B, the bed frame 21 further has a compartment 63 which receives a mattress 35. The bed frame 21 comprises of a rectangular board 80, a rectangular supporting frame 76 and for pivotal legs 71-74. The pivotal legs 71-74 can be attached to the board 80.

Figure 12:
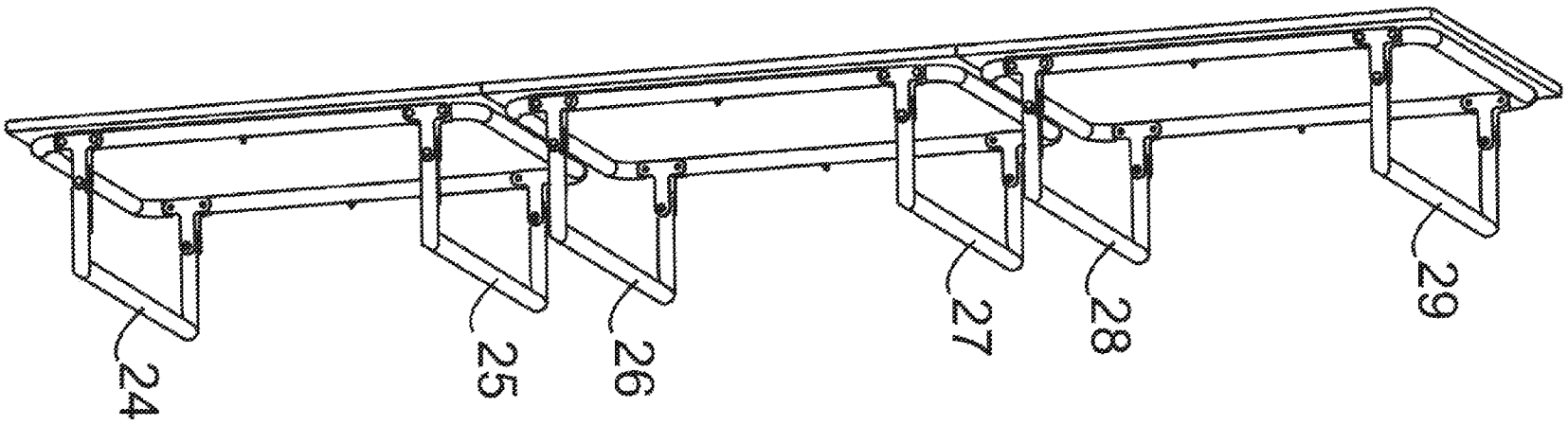
FIG. 12 shows a perspective view of three foldable bed frames of the present invention.

FIG. 12 shows a perspective view of three foldable bed frames of the present invention with six foldable legs 24-29.

Figure 13A:
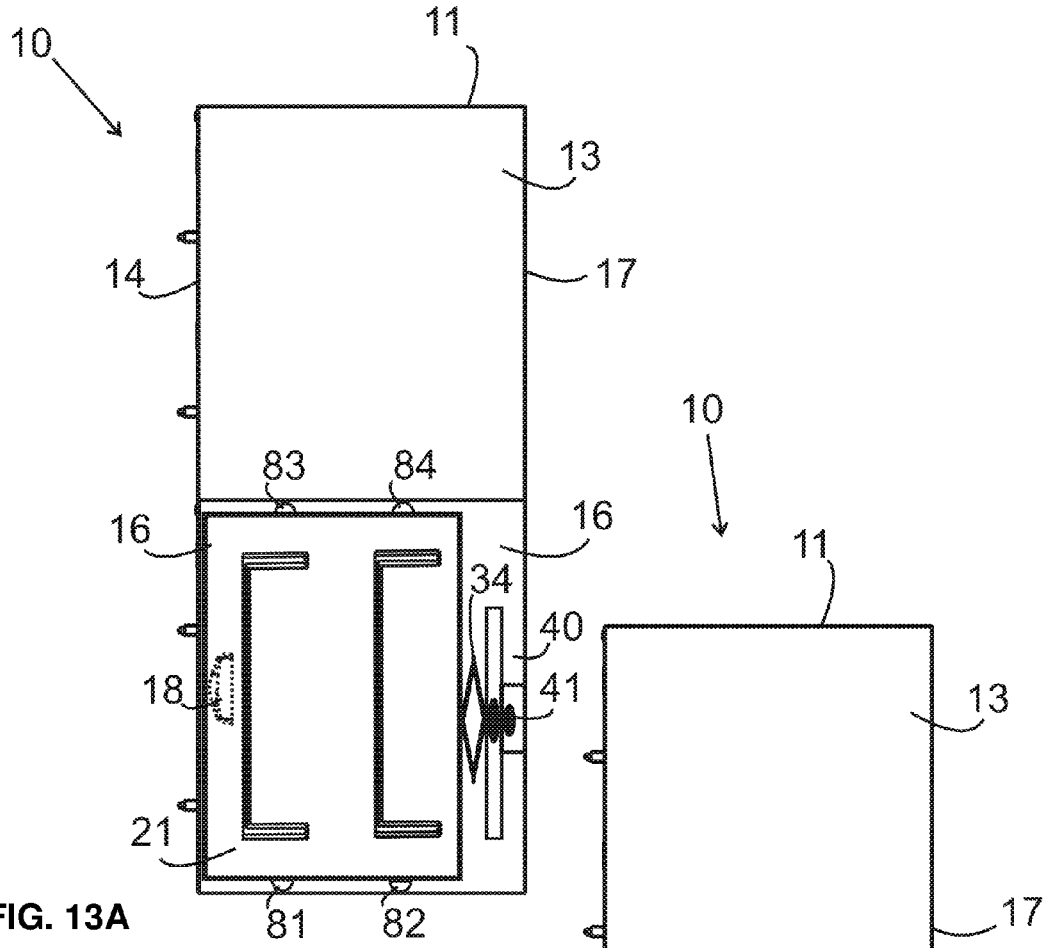
FIG. 13A shows a side view of the folding cabinet bed with the folded bed inside of the cabinet.
Figure 13B:
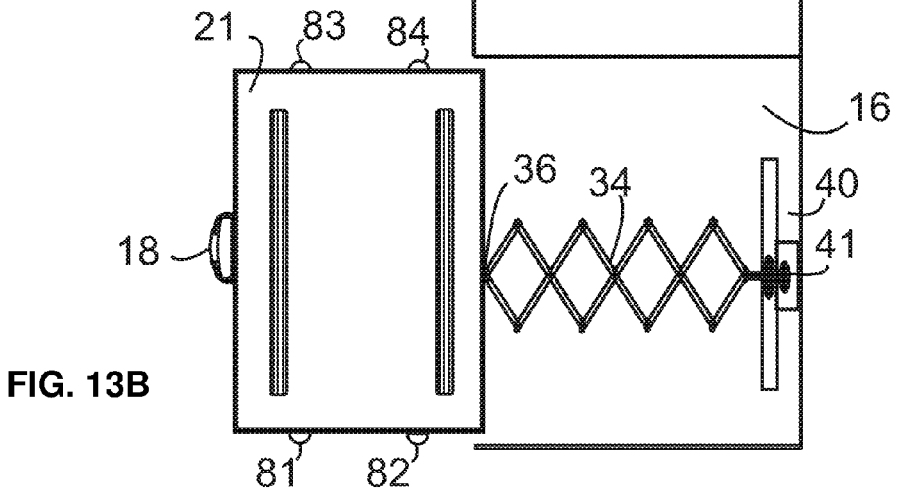
FIG. 13B shows a side view of the folding cabinet bed with the folded bed slid out of the cabinet.

FIGS. 13A and 13B show the folding cabinet 10 in retracted and extended position. The cabinet folding bed 10 comprises of a drawer assembly. The drawer assembly has a gripping handle 18 mounted on the exterior part of the upper section 21 to pull-push and slide the folding bed into and out of the cabinet 10 and to the right and left sides. The drawer assembly further comprises of a scissor shape section 34 to retract and release movement of the foldable beds 21-23. The drawer assembly is affixed to the back side of the lower section of the bed frame 23 from one end 36 and is rotatable embedded in a railing through a rotatable element 40. The railing is mounted to the inner side of the rear wall 17 of the lower compartment of the cabinet 16. The bed can be folded and retracted by pulling or pushing the beds 21-23 and can be rotated and slid to the right and left sides. The drawer assembly is attached to the foldable beds 21-23 from a distal end 36. Again as shown in FIG. 13A, the handle 18 can be built into the foldable bed to save the space.

Again as shown in FIGS. 13A and 13B, the foldable bed further has a plurality of wheels 81-84 which are designed in the foldable bed to enhance the movement of the foldable bed inside the cabinet.

Figure 14A:
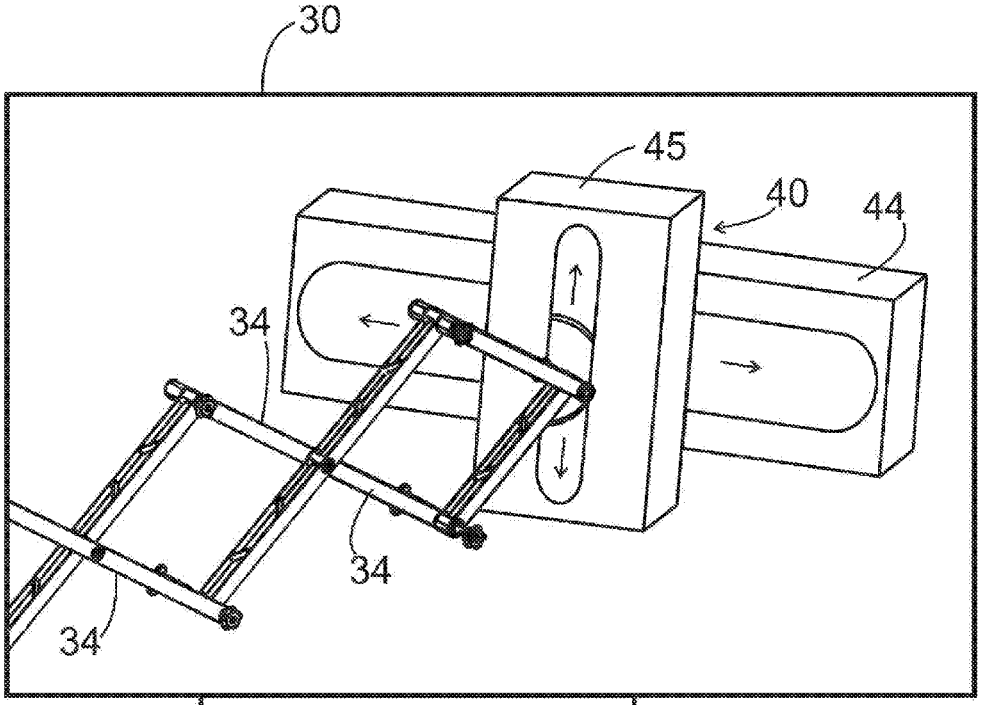
FIG. 14A is a partial view of the rotating and traversing system according to the present invention.
Figure 14B:
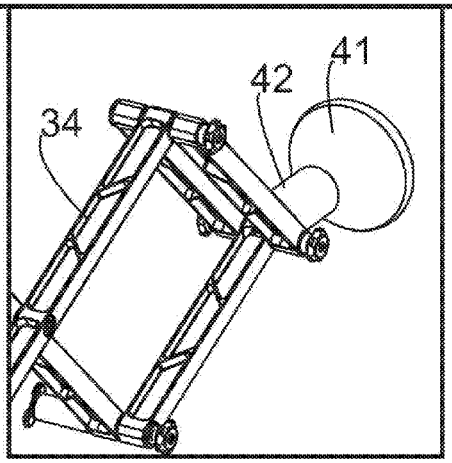
FIG. 14B is a partial view of the rotating system according to the present invention.

FIGS. 14A and 14B show that the rotating bearing 41 allows a clockwise or a counter-clockwise movement of the bed in 360 degrees. According to the present invention, it is essential to rotate the folded bed 20 in order to fit it inside the cabinet 10. The rotating bearing 41 is located inside of a traverse system 40 which is connected to rear wall of the lower compartment of the cabinet 17. The traverse system 40 allows the rotating bearing 41 not only to rotate but to move both in a horizontal 44 and in a vertical 45 directions. The horizontal movement allows the bed to move to the left or to the right as needed. For example, if the cabinet is close to a wall on the right, the bed has to be moved to the left and then opened. In addition, the vertical movement allows for the bed to move downward to have its legs engage with the floor.

Rotating bearing 42 can be supported by any known means, including couplings. Other means for rotation of the bed, similar to the rotating element 40, can also include to connect to the pull assembly. The combination of the rotating element and the drawer assembly provides a pull and rotate movement of the bed.

Figure 15A:
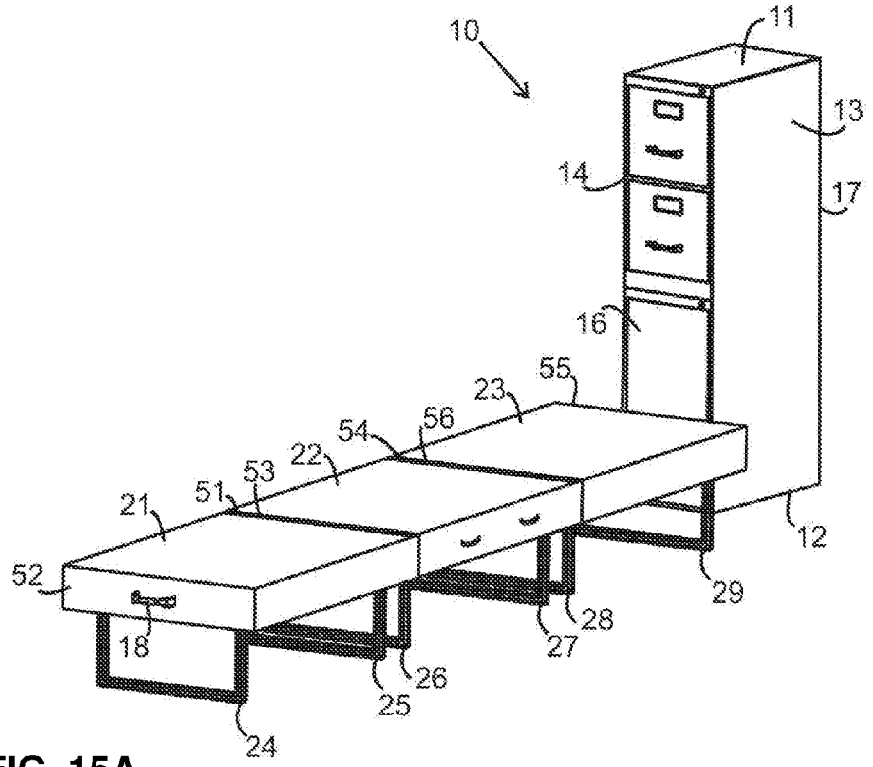
FIG. 15A shows a perspective view of the present invention in the extended position.
Figure 15B:
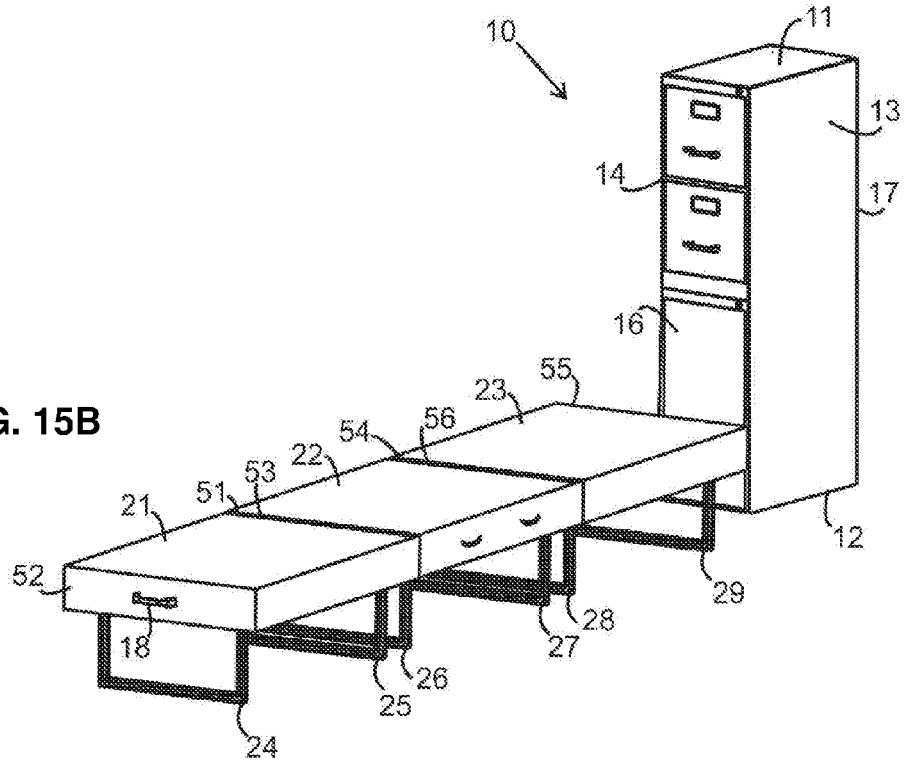
FIG. 15B shows a perspective view of the present invention in the extended position which folded bed slides to the right of the folding cabinet bed.

As shown in FIGS. 15A and 15B, the foldable beds 21-23 can be placed in the middle portion or either a left or a right direction depending on the position of the cabinet proportional to a wall or other obstruction of the filing cabinet 10.

Each of the three sections of the bed frame 21, 22 and 23 are in equal depth (25-35 inches), height (28-38 inches), and width (5-8 inches).

According to the present invention, the three pieces of mattress may be separate pieces. They may also be joined at a seam which is designed to permit mattress portions to be folded up and over each other. Seam can be made of hinged fabric, preferably having double plies for reinforcement. The mattress can be made of foam, laminated foam or other suitable materials.

In another embodiment of the present invention foam shape cushions are embedded in the frame boxes and the support legs can be bent and pushed into the foams and bury in them when the bed is folded.

In another embodiment of the present invention, the whole folding and unfolding process can be mechanized so that the bed would unfold or fold back into the cabinet by pushing a button or by a remote control.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A filing cabinet with a foldable bed, comprising:

a. a cabinet bed compartment having a height, a width, a depth, a rear wall, a left wall and a right wall, and at least one front drawer door;

b. a foldable bed frame comprising of a first section, a second section, and a third section, each section having a first end and a second end, and wherein the second end of the first section is foldably attached to the first end of the second section and the second end of the second section is foldably attached to the first end of the third section;

c. a guide mechanism, to guide the foldable bed in and out of the cabinet bed compartment, having a proximal end and a distal end, wherein said proximal end is attached to the rear wall through a rotatable and traversable attachment means and the distal end is attached to said foldable bed frame, whereby the foldable bed can rotate by 360 degrees and slide horizontally and vertically while attached to the cabinet;

d. a first set of foldable legs attached to said foldable bed frame to support the foldable bed on a floor, and e. a foldable mattress to lie on said foldable bed frame, whereby the foldable bed is retracted by pulling the foldable bed out of the cabinet compartment by a handle attached to the foldable bed, rotating the foldable bed in either a left or right direction, unfolding the three sections of the foldable bed frame so all three sections lie in the same horizontal plane, and retracting the foldable legs to support the foldable bed on a floor.

2. The filing cabinet of claim 1, wherein said guide mechanism comprises a scissor link.

3. The filing cabinet of claim 1, wherein said rotatable and traversable attachment means is a rack and socket system.

4. The filing cabinet of claim 1, wherein said rotatable and traversable attachment means comprises a socket embedded in a traverse system, wherein said traverse system is attached to the rear wall of the cabinet to allow for both horizontal and vertical movements of said socket.

5. The filing cabinet of claim 1, wherein said set of foldable legs comprises: a first pair of legs foldably attached to the first section of the bed, a second pair of legs foldably attached to the second section of the bed, and a third pair of legs foldably attached to the third section of the bed, whereby the legs fold onto the bed sections during storage.

6. The filing cabinet of claim 1, wherein each section of said bed frame comprises an open top box of substantially rectangular shape having side walls and a bottom, said open top box sized to receive a foam mattress.

7. The filing cabinet of claim 1, wherein at least one of said sections has a pair of wheels to allow the bed to roll in and out of the cabinet.

8. The filing cabinet of claim 1, wherein said depth is between 25 to 35 inches.

9. The filing cabinet of claim 1, wherein said height is 28-38 inches to accommodate a 38-inch-wide twin size bed.

10. The filing cabinet of claim 1, wherein said width is at least 15 inches to accommodate a three-folded bed.

11. The filing cabinet of claim 1, wherein said depth is at least 25 inches to accommodate a three-folded 75-inch-long twin size bed.

12. The filing cabinet of claim 1, further having a plurality of filing drawers on top of the cabinet bed compartment.

13. The filing cabinet of claim 1, wherein said foldable mattress comprises of three separate pieces, wherein each mattress piece is sized to fit on one of the three sections of said bed frame.

14. The filing cabinet of claim 1, wherein said foldable mattress comprises three pieces joined at seams which are designed to permit mattress portions to be folded up and over each other.

15. The filing cabinet of claim 14, wherein said seams are made of hinged fabric, having double plies for reinforcement.

16. The filing cabinet of claim 1, wherein said foldable mattress is made of a foam, a laminated foam or other suitable materials.

17. The filing cabinet of claim 1, wherein said mattress is a foam cushion and the foldable legs can be bent and pushed into the foam and buried in the foam when the bed is folded.

* * * * *